US006640795B1

(12) United States Patent
Koike et al.

(10) Patent No.: US 6,640,795 B1
(45) Date of Patent: Nov. 4, 2003

(54) DRESSER, POLISHING APPARATUS AND METHOD FOR PRODUCING AN ARTICLE

(75) Inventors: Eijiro Koike, Machida (JP); Yasutada Nakagawa, Yokohama (JP); Masatoshi Higuchi, Kawasaki (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/671,263

(22) Filed: Sep. 28, 2000

(30) Foreign Application Priority Data

Sep. 29, 1999 (JP) ..... 11-275517
Jul. 19, 2000 (JP) ..... 2000-218299

(51) Int. Cl.[7] ..... B24B 53/53
(52) U.S. Cl. ..... 125/11.03; 125/11.19; 451/444
(58) Field of Search ..... 125/11.01, 11.03, 125/11.19; 451/41, 443, 444, 548, 550, 551

(56) References Cited

U.S. PATENT DOCUMENTS 2,662,519 A * 12/1953 Metzger ..... 451/56
5,611,326 A * 3/1997 Caspani et al. ..... 125/39
5,785,585 A * 7/1998 Manfredi et al. ..... 451/288
6,142,859 A * 11/2000 Ross et al. ..... 451/443
6,200,207 B1 * 3/2001 Hsu ..... 451/443
6,213,856 B1 * 4/2001 Cho et al. ..... 451/443
6,273,797 B1 * 8/2001 Becker et al. ..... 451/56
6,293,854 B1 * 9/2001 Kimura et al. ..... 451/56
6,302,772 B1 * 10/2001 Hosoki et al. ..... 451/56
6,331,136 B1 * 12/2001 Bass et al. ..... 451/56
6,347,981 B1 * 2/2002 Holzapfel ..... 451/56
6,350,184 B1 * 2/2002 Holzapfel ..... 451/72

FOREIGN PATENT DOCUMENTS

JP 9-29633 2/1997
JP 10-315118 12/1998

* cited by examiner

*Primary Examiner*—M. Rachuba
(74) *Attorney, Agent, or Firm*—Finnegan, Henderson, Farabow, Garrett & Dunner, L.L.P.

(57) ABSTRACT

A polishing apparatus comprise a lower surface plate rotatably provided and having a polishing surface for polishing an object, and an upper surface plate for pressing the object against the lower surface plate, wherein the polishing surface can be dressed by a dresser comprising a dressing member approachable to and separable from the polishing surface, the dressing member having a dressing surface to be brought into contact with the polishing surface, the dressing surface being shaped as a hollow oval.

5 Claims, 3 Drawing Sheets

DRESSER, POLISHING APPARATUS AND METHOD FOR PRODUCING AN ARTICLE

CROSS-REFERENCE TO RELATED APPLICATIONS

This application is based upon and claims the benefit of priority from the prior Japanese Patent Applications No. 11-275517, filed Sep. 29, 1999; and No. 2000-218299, filed Jul. 19, 2000, the entire contents of which are incorporated herein by reference.

BACKGROUND OF THE INVENTION

The present invention relates to a polishing method for polishing a worked object, and more particularly to a dresser for use in dressing a polishing work surface of a polishing apparatus.

Production of articles may require a step of polishing materials constituting the articles in large quantities with high accuracy by means of a polishing work surface, for example, a surface of a polishing cloth. The materials to be polished may be plate objects, such as silicon wafers, ceramic boards and SOI (Silicon On Insulator) boards, or objects other than the plate objects, such as magnetic heads for use in magnetic recording apparatuses or prisms for use in optical apparatuses.

In the aforementioned step, the conditions of the surface of the polishing cloth vary from batch to batch due to being clogged with chippings from the polished objects. Therefore, the polished amount or the flatness of the polished object in the same working time may vary unless some measure is taken. Therefore, it is necessary to perform a process for dressing the polishing work surface made of the surface of the polishing cloth in order to keep the work surface in the same, uniform condition in every batch.

FIGS. 5A and 5B show a dresser having a dressing member. The dressing member 21 of the dresser, mounted on a base board 20, is cylindrical, having an outer diameter of about 28 cm, an inner diameter of about 26 cm, and a thickness of about 2 cm. The dresser is screwed to a jig 23 via screw holes formed in the base board 20. The dressing member 21 has recesses 22 arranged at almost regular intervals to allow passage of a polishing liquid. Conventionally, the dresser having the above structure is brought into contact with a rotating polishing cloth, while it is rotating about a center O of the base board 20, thereby performing a dressing process.

In the dressing process, the surface of the polishing cloth must be abraded by about 1 $\mu$m each time polishing is performed, from the viewpoint of insuring precision of the shape of the articles and stability of the work condition. When the polishing cloth is abraded about 1 mm from the initial state, it is at the end of its life and exchanged for a new one.

According to the conventional art, even when a portion of the polishing cloth, which directly contributes to polishing of wafers, is still usable, an outer or inner periphery of the polishing work surface is excessively thinned. If an outer or inner periphery of the polishing work surface is worn by a given amount or more, while a portion of the polishing cloth which directly contributes to polishing of wafers is still available for polishing, the balance of the tension and the like exerted on the polishing cloth will be lost and the polishing condition will be unstable. In this case, it will be difficult to polish the object with high accuracy. Therefore, the polishing cloth must be exchanged.

BRIEF SUMMARY OF THE INVENTION

A first object of the present invention is to provide a dresser which suppresses variation in the amount of work in dressing, and a polishing apparatus using the dresser.

To achieve this object, there is provided a dresser approachable to and separable from a polishing surface of a polishing apparatus, and having a dressing surface to be brought into contact with the polishing surface, the dressing surface being shaped as a substantially hollow triangle or a substantially hollow oval, or a dresser rotatable about a rotation axis and approachable to and separable from a polishing surface of a polishing apparatus by means of the rotation axis, wherein the dresser can be arranged on the polishing apparatus such that, in a region where the polishing surface actually polishes an object, an integral of a function of a product of a time during which the polishing surface is in contact with the dressing member and a relative velocity at a time when the polishing surface contacts to the dressing member, with respect to a dressing time, is at least equal to that in inner and outer peripheral portions of the polishing surface.

A second object of the present invention is to provide a polishing method which suppresses variation in the amount of work in dressing.

To achieve this object, there is provided a method for producing an article, comprising: a dressing step for bringing any dresser mentioned above into contact with a polishing surface; and a polishing step for, after the dressing step, bringing an object into contact with the polishing surface, thereby polishing the object.

According to the present invention, the lifetime of the polishing work surface can be prolonged. Thus, since the number of times of exchanging the polishing cloth is substantially reduced, the lead time required for production of articles can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
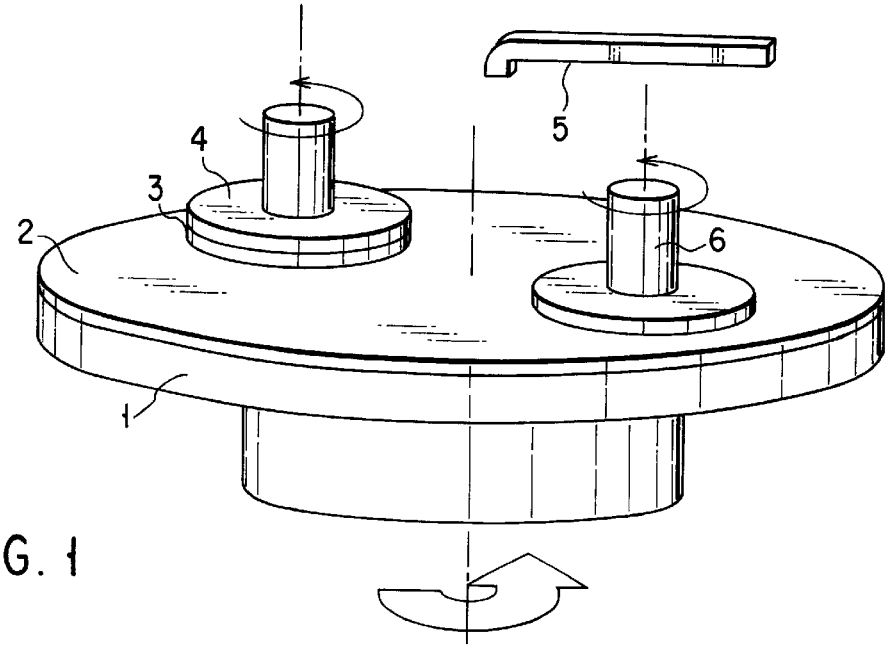
FIG. 1 is a schematic diagram showing a polishing apparatus according to an embodiment of the present invention.

Embodiments of the present invention will be described below with reference to the accompanying drawings. A polishing apparatus shown in FIG. 1 comprises: a lower surface plate 1 rotatable about a rotation axis thereof; a polishing cloth 2 adhered to the lower surface plate 1; an upper surface plate 4, rotatable about a rotation axis thereof parallel to the rotation axis of the lower surface plate 1, for uniformly pressing and holding the overall surface of an object 3 to be worked which is placed on the polishing cloth 2; a nozzle 5 for supplying a polishing liquid to the polishing cloth 2; and a dresser 6 rotatable about a rotation axis thereof parallel to the rotation axis of the lower surface plate 1 at a different position from the upper surface plate 4 and having a dressing surface approachable to and separable from the polishing cloth 2.

The polishing apparatus having the above structure performs a polishing process as will be described below. The dresser 6, the lower surface plate 1 to which the polishing cloth 2 is adhered, forming the polishing surface, and the upper surface plate 4 holding the object 3 are rotated about the respective rotation axes in the same direction at tens to hundreds of revolutions per minute (rpm). Pure water if necessary, mixed with a surfactant, is supplied through the nozzle 5 to a portion near the center of rotation of the lower surface plate 1. The Pure water is used to suppress a change in quality of abrasive grains which are electro-deposited to the surface of the dresser 6. Mixture of water and surfactant is spread over the polishing cloth 2 by centrifugal force generated by rotation of the lower surface plate 1.

Then, while the dresser 6 is rotating, the dressing surface is pressed against the polishing cloth 2 for a predetermined period of time at hund dresser 6 and that of the lower surface plate 1 are set to be different by several rpm, so that the rotations of the dresser 6 and the polishing cloth 2 are not synchronous with each other. Owing to the different numbers of revolutions, the polishing cloth 2 is prevented from receiving an axially-asymmetric dressing action. After elapse of a predetermined period of time, the dresser 6 is separated from the polishing cloth 2 and the rotational operation thereof is stopped.

Then, a polishing liquid is supplied to the lower surface plate 1 through the nozzle 5, and the object 3 to be worked is brought into contact with and pressed against the polishing cloth 2 while the upper surface plate 4 is rotating. In the case where the object 3 is a semiconductor wafer for use in producing, for example, a DRAM (Dynamic Random Access Memory), the upper surface plate 4 and the lower surface plate 1 are rotated at about 100 rpm and the wafer is pressed against the surface of the polishing cloth 2 at hundreds of N, thereby polishing the wafer. Generally, when polishing is performed, the numbers of revolutions of the upper surface plate 4 and the lower surface plate 1 are set to be different by several rpm, so that the rotations of the two plates 4 and 1 are not synchronous with each other.

If the object to be polished is an oxide film laid on the semiconductor wafer, a suspension is prepared by mixing aluminum, $CeO_2$ or $SiO_2$ abrasive grains having grain diameters of the order of sub-microns with pure water containing a surfactant, and it is used as the polishing solution. However, depending on the material or the required specifications of the object to be worked, pure water or diamond slurry solution can be used as the polishing liquid.

After elapse of a predetermined period of time, the rotation of the lower surface plate 1 and the upper surface plate 4 is stopped. At the same time, the object 3 is separated from the polishing cloth 2 and removed from the upper surface plate 4. Thus, the polishing is completed. If polishing is carried out successively, the above process is repeated with another object held by the upper surface plate 4.

A dressing member used in the dresser 6 will now be described. The dressing member for use in, for example, a wafer polishing apparatus, is made of a super-abrasive electro-deposited grindstone or brazed grindstone, shaped or arranged to form a cylinder having a thickness of about 2 cm. More specifically, a columnar stainless-steel or SUS material having a diameter of about 28 cm is cut to form a cylindrical body serving as the dressing member. One end of the cylindrical body is open, whereas the other end thereof is closed since the stainless-steel or SUS material is left as a base plate. Diamond abrasive grains having diameters of about 50 to 200 $\mu$m are adhered by electrolytic deposition to the end face of the projecting portion at the open end of the cylinder projecting from the base plate. The abrasive grains adhered by electrolytic deposition are fixed to the projecting portion of the cylinder with epoxy resin. Thus, the end of the projecting portion is used as a dressing surface, which is brought into contact with the polishing cloth.

The dressing surface has some recesses to cut the dressing member to accelerate the passage of the polishing liquid supplied through the nozzle. The liquid flows through a gap between the polishing cloth and the recesses, whereby it moves from the inside to the outside of the dresser and vice versa. For this reason, the dresser has a cylindrical shape, in which no dressing member is present immediately under the rotation axis of the dresser, so that chippings from the polished object or the polishing cloth can be prevented from remaining in the gap between the dressing member and the polishing cloth. It is preferable that the cylindrical dressing member have recesses in parts thereof in order to accelerate the passage of the polishing liquid. The recesses are formed when the base portion of the dressing member is cut out from the material.

In the case where the dresser is rotated, it is preferable that the recesses be formed in portions farthest from and portions nearest to the rotation axis thereof.

Figure 2:
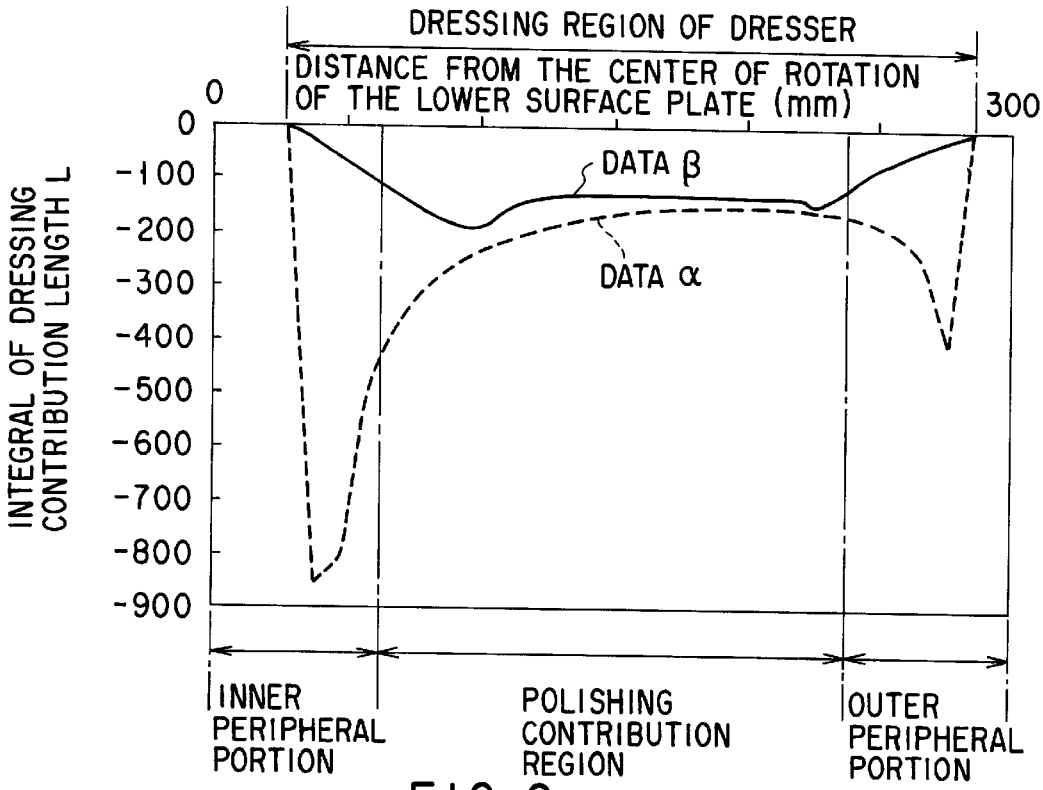
FIG. 2 is a graph showing the length of that portion which contributes to dressing along the radial directions of the polishing cloth used in the dresser of the present invention.

FIG. 2 is a graph showing a value obtained by integrating the length L of the portion of the dresser which contributes to dressing (hereinafter referred to as dressing contribution length L) with the dressing time. A dressing operation of the dresser will be described concretely with reference to the graph. Based on the empirical rule of Prestom, the amount h of dressing work at an arbitrary point on the dressing surface is proportional to a working pressure (compressive stress) P, a relative velocity V when the object contacts the dressing member, and a work time t. Since the working pressure P can be uniform to a certain extent by regulating the surface plate for holding the dressing member, it is generally considered to be a constant. Therefore, the amount h of dressing work can be represented simply by the following equation (1):

$$h \propto v \cdot t \tag{1}$$

A dressed amount of a polishing cloth will be discussed using the above equation (1). It is assumed that a relative velocity vector of an arbitrary point on a polishing cloth of 300 mm radius and a point on the dresser in contact with the arbitrary point is V[m/sec], a contact time during which the two points are in contact is t, and the product of the relative velocity vector V and the contact time t is the dressing contribution length L[m].

Figure 5A:
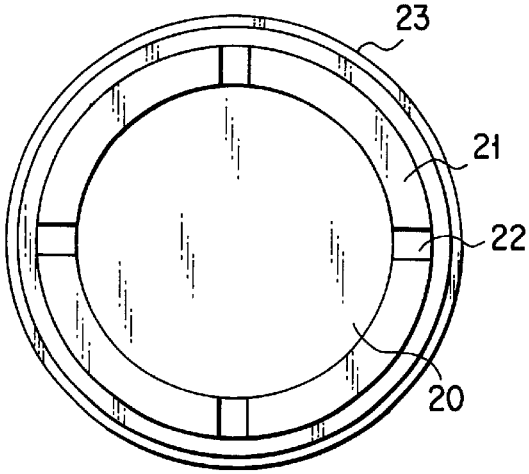
FIG. 5A (PRIOR ART)
FIGS. 5A and 5B are schematic diagrams showing the structures of the conventional dresser and jig.
Figure 5B:
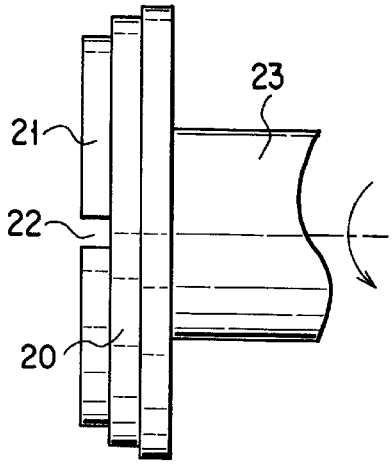
FIG. 5B (PRIOR ART)

In the case where the dresser and the lower surface plate are rotating in the same direction, the relationship between the distance in a radial direction of the polishing cloth and the integral of the dressing contribution length L with respect to a dressing time of an annular dresser shown in FIGS. 5A and 5B has an inclination represented by "data α" in the graph shown in FIG. 2. It is understandable from the inclination of data α that, in a dressing region corresponding to the outer diameter of the dressing member of the dresser, the dressing contribution lengths L in the outer peripheral portion of the polishing cloth and the inner peripheral portion near the center of rotation of the polishing cloth are about 2 to 4 times the minimum value of the length L in a polishing contribution region which is actually brought into contact with the object when the object is polished.

Variation in dressing contribution length L is substantially equivalent to variation in dressing amount. The degree of variation also substantially coincides with a measured value of the dressing contribution length. Although the rotation rate and the direction of rotation of the dresser or the polishing cloth influence the variation in dressing contribution length, there is no characteristic change in inclination of the variation. Further, although the integral is negative because the length along the direction of rotation is defined as positive, the greater the absolute value of the integral, the greater the dressed amount of the polishing cloth.

In contrast, the dressing surface of the dresser of the present invention has a shape optimized in accordance with the required specification by evaluating the distribution of the dressing contribution length on the dressing surface with the equation (1). According to the present invention, the shape is determined so as to maintain the dressing contribution length on the dressing surface as constant as possible and make it easy to design or work with the dressing member.

Figure 3A:
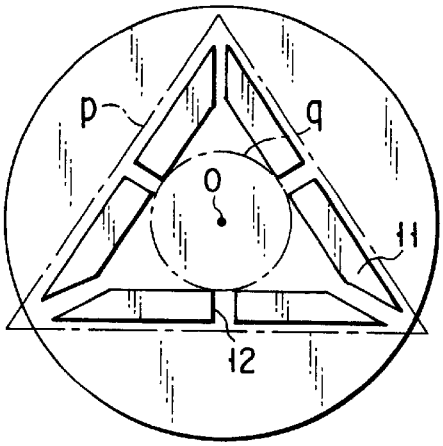
FIG. 3A is a schematic diagram showing a dresser of an embodiment which has a triangular dressing surface.

FIG. 3A is a schematic diagram showing a dresser which has a hollow triangular dressing surface. An envelop p of an outer periphery a dressing member, i.e., a grindstone 11, has a hollow triangular cross section on a plane perpendicular to the rotation axis of the dressing member. Recesses 12 allow passage of a polishing liquid and are provided near portions corresponding to the vertexes of the triangle, and also near the points of contact between the envelope of the inner periphery of the grindstone and the inscribed circle q. It is preferable that the recesses be formed in portions farthest from the rotation axis to accelerate discharge of the polishing liquid to the outside of the triangle and portions nearest to the rotation axis to accelerate entrance of the polishing liquid to the inside of the triangle.

The dressing contribution length L of the dresser shown in FIG. 3A has an inclination indicated as data β on FIG. 2. It is understandable that the dressing amount in the peripheral portions of the polishing cloth is reduced as compared to that in the inclination of the data α obtained in the case where the annular dresser is used. Further, since the dressing amount in the peripheral portions of the polishing cloth is smaller than that in the polishing contribution region thereof, the life of the polishing cloth can be prolonged. In other words, the dressing contribution length is set at its maximum value in the polishing contribution region which is brought into contact with the object to be polished. As a result, the life of the polishing cloth can be prolonged, and the diameter of the dresser can be smaller.

Figure 3B:
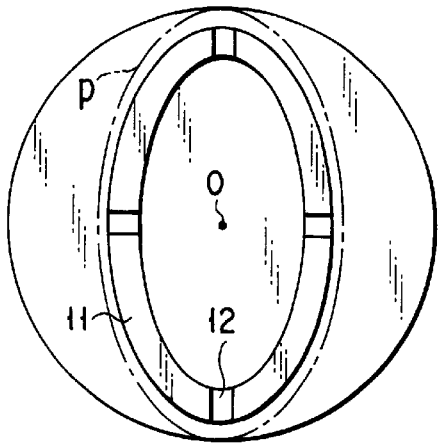
FIG. 3B is a schematic diagram showing a dresser of another embodiment which has an oval dressing surface.

The dressing contribution length L of the dresser shown in FIG. 3A has an inclination indicated as data β in FIG. 2. It is understandable that the dressing amount in the peripheral portions of the polishing cloth is reduced as compared to that in the inclination of the data α obtained in the case where the annular FIG. 3B is a schematic diagram showing a dresser which has an oval-cylindrical dressing member. An envelop of an outer periphery of the dressing member, i.e., a grindstone 11, has an oval shape. The dresser is rotated about an axis passing through the intersection of the major axis and the minor axis of the oval. Recesses 12 allow passage of a polishing liquid and are provided at the intersections of the oval and its major and minor axes. On the oval dressing surface as described above, the dresser has a dressing action mainly on the polishing contribution region, and less dressing action on the peripheral portions of the polishing cloth than on the polishing contribution region, as represented by data β shown in FIG. 2.

Figure 4A:
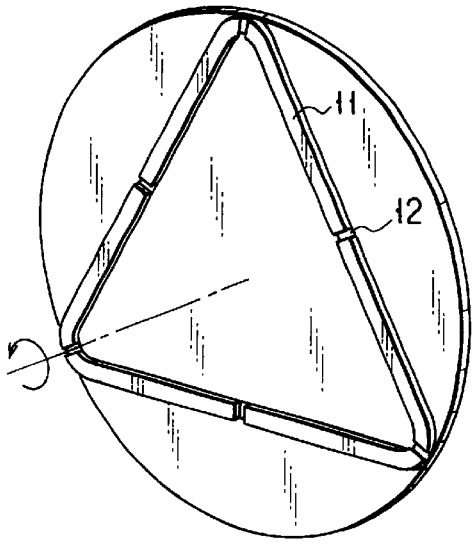
FIGS. 4A to 4C are schematic diagrams showing modifications of the dresser of the present invention.
Figure 4B:
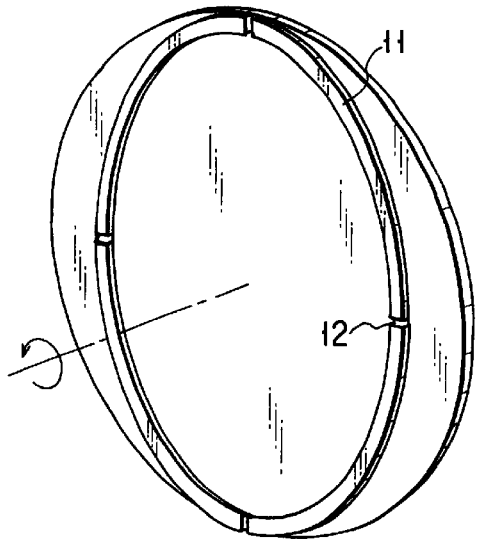
Figure 4C:
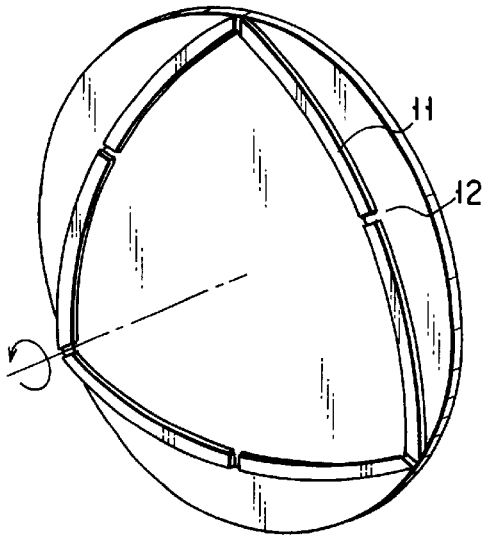

FIGS. 4A to 4C show modifications of the shape of the dressing member of the dresser. In the case where the dressing member is basically triangle, if a vertex of the triangle or an edge portion of a recess is acute, the polishing cloth may be damaged by the acute portion. Therefore, it is preferable that the edge portions be rounded or cut by forming grooves connecting the inside and the outside of the dressing member.

Similar to the modifications shown in FIG. 4A, the vertexes of the triangle may be formed by arcs of about 30 mm radius. As regards the interior angles of the vertexes of the triangle, if the gap between sides of the triangle is acute, the polishing cloth may be caught in the gap. Therefore, it is also preferable that the interior angles, as well as the vertexes, be rounded and have a recess on the dressing surface.

Similar to the modifications shown in FIG. 4B, the ratio of the length of the major axis to that of the minor axis, i.e., the flatting of the oval, may be suitably changed according to circumstances. If the variation in dressing contribution length is optimized with respect to the polishing contribution region, the sides constituting the triangle may be formed of arcs curved outward from the center of the triangle. Such a shape is also assumed to be a triangle.

Whether the sides are formed of straight lines or arced lines like the modifications shown in FIG. 4C, they can be suitably selected in accordance with the working method for cutting out the base from the material or performance required for the dresser. In other words, according to the present invention, if a shape has three curved lines having a radius of curvature smaller than that of three arc sides of a triangle (including a infinite radius of curvature) by for example, about several centimeters, the shape of the dressing surface of the dresser is considered as substantially triangular. Further, the triangular shape may be separated by grooves.

The envelope of the outer periphery of the dressing surface and that of the inner periphery are not necessarily geometrically similar.

Further, although the bottom of the cylinder of the dressing member has a basically oval or triangular shape in the above embodiments, when the distribution of the dressing amount is to be positively controlled, the shape of the bottom of the cylinder may be constituted by a free curve or a plurality of straight lines. Moreover, the width of the dressing surface may be suitably changed.

As described above, with the dressing method using the dresser, the variation in dressing amount during a dressing process can be reduced. Therefore, the number of objects polished by one polishing cloth can be increased. In addition, the polishing cloth, dressed by the dresser in which the dressing contribution length is regulated, has a flat surface having less convexities and concavities formed after dressing. Therefore, a surface of the object (for example, a wafer surface), to which the shape of the polishing cloth is transferred, can be super-flattened to a flatness in the order of tens of nm. Furthermore, the polishing surface can be wide and the number of convexities and concavities can be less after dressing. Therefore, a larger object can be polished flat by a relatively small surface plate.

Furthermore, the present invention can be modified within the scope of the gist of the invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A dresser comprising a dressing member having a dressing surface to be brought into contact with a polishing surface of a polishing apparatus, the dressing surface being shaped as a hollow oval, wherein:

at least one recess is formed on the dressing surface at the intersections of the oval and its major and minor axes;

the dressing member is rotatable about a rotation axis; and the recess is formed to separate the dressing surface in portions of the dressing member farthest from the rotation axis.

2. A dresser according claim 1, wherein a recess formed to separate the dressing surface in portions of the dressing member nearest to the rotation axis.

3. A dresser according to claim 1, further comprising: abrasive grains arranged on the dressing surface.

4. A polishing apparatus comprising:

a first surface plate rotatably provided and having a polishing surface for polishing an object;

a second surface plate for pressing the object against the first surface plate; and a dresser recited in claim 1 to dress the polishing surface.

5. A method for producing an article comprising:

a dressing step for bringing a dresser recited in claim 1 into contact with a polishing surface; and a polishing step for, after the dressing step, bringing an object into contact with the polishing surface, thereby polishing the object.

* * * * *

UNITED STATES PATENT AND TRADEMARK OFFICE

CERTIFICATE OF CORRECTION

PATENT NO. : 6,640,795 B1
DATED : November 4, 2003
INVENTOR(S) : Koike et al.

It is certified that error appears in the above-identified patent and that said Letters Patent is hereby corrected as shown below:

Column 8,
Line 5, after "according" insert -- to --.
Line 5, after "recess" insert -- is --.

Signed and Sealed this

Sixteenth Day of March, 2004

JON W. DUDAS
*Acting Director of the United States Patent and Trademark Office*